US005420557A

United States Patent [19]

Chern

[11] Patent Number: 5,420,557

[45] Date of Patent: May 30, 1995

[54] MAGNETIC DRAIN PLUG

[76] Inventor: Yih-Jyh Chern, No. 17-3, Kuang-Fu Rd., Ta-Ya Hsiang, Taichung Hsien,

[21] Appl. No.: 32,154

[22] Filed: Mar. 15, 1993

Related U.S. Application Data

[63] Continuation-in-part of Ser. No. 864,951, Apr. 7, 1992, abandoned.

[51] Int. Cl.[6] ..... H01F 7/02

[52] U.S. Cl. ..... 335/305; 184/6.25

[58] Field of Search ..... 335/305; 210/695, 222, 210/223; 74/606 R; 208/179; 184/6.25

[56] References Cited

U.S. PATENT DOCUMENTS

| | | | |
|---|---|---|---|
| Re. 20,291 | 3/1937 | Bock | 335/305 |
| 2,242,830 | 5/1941 | Lisle | 335/305 |
| 2,345,029 | 3/1944 | Brooks | 335/305 |
| 2,450,630 | 10/1948 | Bourne | 335/305 X |
| 2,755,932 | 7/1956 | Cohn | 335/305 |
| 2,878,342 | 3/1959 | Arthur | 335/305 X |
| 2,910,632 | 10/1959 | Spodig | 335/305 |
| 2,983,385 | 5/1961 | Botstiber | 335/305 |
| 4,810,148 | 3/1989 | Aisa et al. | 335/305 X |
| 4,851,116 | 7/1989 | Tomita | 335/305 X |
| 4,940,207 | 7/1990 | Katsuyama | 335/306 X |

FOREIGN PATENT DOCUMENTS

| | | | |
|---|---|---|---|
| 549422 | 11/1957 | Canada | 335/305 |
| 1069403 | 1/1980 | Canada | 335/305 |
| 855607 | 5/1940 | France | 317/201.5 |
| 1029142 | 5/1953 | France | 335/305 |
| 1126255 | 11/1956 | France | 335/305 |
| 566011 | 12/1944 | United Kingdom | 335/305 |
| 705981 | 3/1954 | United Kingdom | 335/305 |
| 864450 | 4/1961 | United Kingdom | 335/305 |

*Primary Examiner*—Vinh T. Luong

[57] ABSTRACT

A magnetic drain plug comprises a resilient plastic plug member and a permanent magnet disposed therein. The plug member has a threaded upper section, a medial flange, and a lower head section with engagement surfaces for a hand tool such as a wrench. An axial bore formed through the plug member defines a tapered upper channel, a medial chamber, and a lower aperture therein. The chamber has a section larger than that of the adjoining channel or aperture. The magnet is forcibly inserted through the upper channel, which is in communication with the interior of a lubricating housing when the plug is mounted therein, so as to snap fit into the conformingly shaped chamber. The lower aperture brings the magnet into communication with ambient air to assist cooling.

1 Claim, 1 Drawing Sheet

MAGNETIC DRAIN PLUG

This is a Continuation-in-part of application Ser. No. 07/864,951, filed on Apr. 7, 1992 now abandoned.

BACKGROUND OF THE PRESENT INVENTION

The present invention relates to a magnetic drain plug for collecting particulate iron from the oil of a lubricating system, and more particularly to a magnetic drain plug having a molded plastic plug member which facilitates manufacture and assembly and which protects the magnet therein from stress and heat.

More conventional magnetic drain plugs generally employ metal plug members which require a plurality of forming steps to manufacture and additional elements for the securement of the magnet, such as fasteners, adhesives, and caulking compounds. The plastic plug member of the present invention can be rapidly manufactured by injection molding so as to simplify production. Moreover, the resilience of the plastic material enables a snap fit securement so as to obviate additional elements and simplify assembly of the magnet therewith. The plug member also provides a lower aperture in communication with the magnet therein which, along with the lower thermal conductivity of the plastic structure, aids in cooling the magnet to prevent loss of remanence.

SUMMARY OF THE PRESENT INVENTION

A magnetic drain plug, in accordance with the present invention, comprises a plastic plug member having an axial bore formed therethrough, and a permanent magnet disposed in a medial chamber portion in the bore. The bore has a tapered tipper portion descending and reducing in section within the threaded upper end of the plug member to the enlarged section chamber portion. The magnet is forcibly inserted through the tapered portion to snap fit into the chamber portion during the assembly of the drain plug. A lower portion of the bore extends downward from the chamber portion through the lower head end of the plug member which has engagement surfaces, such as a hexagonal outer periphery, formed therearound for engagement with a torque applying tool. The aperture defined by the lower portion of the bore brings cooling air into communication with the magnet.

It is thus a first object of the present invention to provide a magnetic drain plug having a plastic plug member which facilitates manufacturing and assembly.

A further object of the present invention is to provide a magnetic drain plug as characterized which protects the magnet therein from mechanical stress and vibration.

Yet another object of the present invention is to provide a magnetic drain plug as characterized which aids in the cooling of the magnet therein.

DETAILED DESCRIPTION OF THE PREFERRED EMBODIMENT

Figure 1:
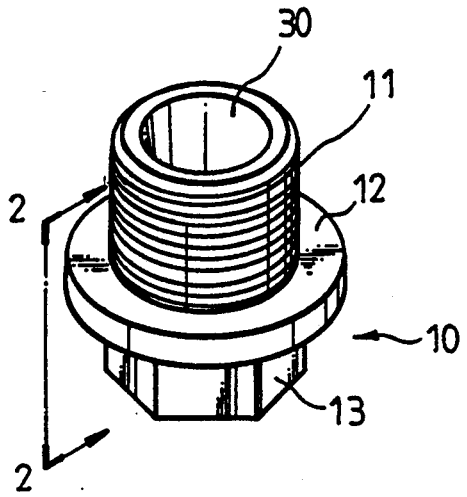
FIG. 1 is a perspective view of the magnetic drain plug of the present invention.
Figure 2:
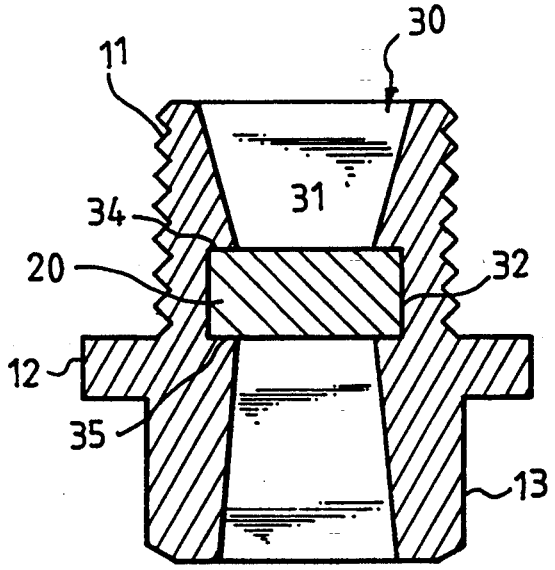
FIG. 2 is a sectional view of the magnetic drain plug taken along section line 2—2 of FIG. 1.

Referring to FIGS. 1 and 2 of the drawings, a magnetic drain plug comprises a plug member 10 of a molded heat and wear-resistant compound, such as polyacetal resin, and a permanent magnet 20 of a suitable high coercivity material, such as cobalt-samarium alloy, disposed therein.

The plug member has a threaded upper section 11, a medial flange 12 below the threaded section, and a lower head section 13 of hexagonal form for engagement with a wrench used to rotate the plug. The upper section 11 engages cooperating threads in a drain hole of a gearbox, or other lubricating oil containing assembly, when the magnetic drain plug is mounted thereunder.

An axially aligned bore 30 of varying section is formed through the plug member and has an upper tapered portion 31, a medial chamber portion 32 conforming in shape with the periphery of magnet 20, and a tapered lower portion 33. The tapered portion 31 extends downward from the top of the threaded section 11 and reduces in section towards the chamber portion 32. The lower portion 33 descends and enlarges from the chamber portion towards an opening on the bottom of head section 13 defined thereby. The chamber portion of bore 30 has a larger section than that of the junctures of either upper or lower portion 31,33 therewith so as to define a reentrant cavity for the magnet.

The magnet 20 is inserted through the tapered portion of bore 30 during the assembly of the drain plug, wherein the resilient plug member 10 expands to allow its intromission and recovers to snap fit the magnet within cavity portion 32. Both the tapered upper portion 31 and the lower portion 33 define respective upper and lower steps 34, 35 with the chamber portion so that the magnet is securely positioned within the plug member.

Thus the plug member 10, which can be ecomically manufactured by injection molding of a thermoplastic compound such as polyacetal resin, eliminates the need for extraneous fasteners or sealing compounds for the securement of the magnet and simplifies the assembly of the magnetic drain plug.

Further, the lower portion 33 of the bore brings the bottom of magnet 20 into communication with ambient air below the drain plug to cool the magnet and prevent possible loss of remanence due to overheating. Note also that the plastic material of the plug member aids in reducing the amount of heat transferred to the magnet in comparison to metal plugs owing to its lower thermal conductivity, and attenuates vibrations which might damage the magnet or cause loss of remanence.

It should be understood that the above disclosure is to be construed not in a limitative sense in relation to the scope of the present invention but rather as being exemplary thereof, with the actual spirit and scope of the present invention being determined from the appended claim and its legal equivalents.

I claim:

1. A magnetic drain plug comprising:

a plug member of a resilient plastic compound having;

a) an upper threaded section;

b) a medial flange below said threaded section:

c) a lower head section having engagement surfaces for engaging cooperating surfaces of a torque applying tool when said plug member is mounted or removed from said housing;

d) an axial bore extending from the top of said threaded section to the bottom of said head section, said axial bore having;

i) a medial chamber portion:

ii) a tapered upper portion extending from the top of said threaded section and reducing in section towards the chamber portion adjoined therewith, the upper portion and the chamber portion defining a first step therebetween;

iii) a lower portion extending from the bottom of said head section to the chamber portion, the lower portion and the chamber portion defining a second step therebetween;

e) a permanent magnet having an outer periphery of section substantially equal with that of the chamber portion of said bore and being disposed therein between the first step and the second step, wherein said plug member has sufficient resilience to allow the forceable insertion of said magnet through the tapered upper portion of said bore and into the chamber portion thereof.

* * * * *